US007171834B2

(12) United States Patent
Robinson

(10) Patent No.: US 7,171,834 B2
(45) Date of Patent: Feb. 6, 2007

(54) EXTERNAL SLEEVE ASSISTED TUBE BENDING

(76) Inventor: Ross G. Robinson, 196 Old Onondaga Road, Brantford, Ontario (CA) N3T 5L4

( * ) Notice: Subject to any disclaimer, the term of this patent is extended or adjusted under 35 U.S.C. 154(b) by 231 days.

(21) Appl. No.: 10/829,514

(22) Filed: Apr. 22, 2004

(65) Prior Publication Data

US 2005/0235719 A1 Oct. 27, 2005

(51) Int. Cl.
*B21D 7/04* (2006.01)
*B21D 9/00* (2006.01)

(52) U.S. Cl. ..... 72/149; 72/369

(58) Field of Classification Search ..... 72/149, 72/154, 157, 159, 369, 150; 29/423
See application file for complete search history.

(56) References Cited

U.S. PATENT DOCUMENTS 2,812,004 A * 11/1957 Huet ..... 72/154
2,856,981 A * 10/1958 Hitz ..... 72/150
2,882,953 A * 4/1959 Huet ..... 72/159
4,009,601 A * 3/1977 Shimizu ..... 72/369
4,137,743 A * 2/1979 Schwarze ..... 72/150
4,377,894 A * 3/1983 Yoshida ..... 29/421.1
4,563,891 A * 1/1986 Schwarze ..... 72/149
5,214,950 A * 6/1993 Grobbenhaar ..... 72/150
5,315,852 A * 5/1994 Talley et al. ..... 72/149
5,765,285 A * 6/1998 Buy et al. ..... 29/890.149
5,937,686 A * 8/1999 Arai ..... 72/150

* cited by examiner

*Primary Examiner*—Lowell A. Larson
*Assistant Examiner*—Teresa M Bonk
(74) *Attorney, Agent, or Firm*—Michael J. Seymour; Eric Marich

(57) ABSTRACT

A method and apparatus for bending tubes particularly suited for bending thin-walled tubing into a tight radius bend. An external sleeve is used during the bending process which maintains the tube cross sectional area and tube wall thickness, thereby eliminating the need for a wiper die or an internal mandrel. In one embodiment the sleeve is split along its longitudinal axis.

14 Claims, 3 Drawing Sheets

EXTERNAL SLEEVE ASSISTED TUBE BENDING

FIELD AND BACKGROUND OF INVENTION

The present invention relates generally to the field of bending tubes for use in a furnace, among other things, and in particular to a new and useful apparatus and method for bending a boiler tube to permit tighter radius tube bends.

Tubes for steam generating equipment, such as fossil-fueled boilers, must be bent to form the various shaped components within them. Rotary draw bending machines are currently used to bends much of the 1 to 3 inch O.D. (outside diameter) tubing used in high pressure steam boilers for electric power generation. U.S. Pat. No. 5,315,852, issued to The Babcock & Wilcox Company, is an example of a current rotary draw bending apparatus and method, which is incorporated herein by reference as though fully set forth.

In rotary draw tube bending, a tube is located in the semi-circular groove of a bend die having an overall radius approximately equal to the desired tube bend radius. Next, a pressure die and clamp die are moved up against the opposite side of the tube with the clamp die clamping the front part of the tube to the bend die. The bend die and clamp die are then rotated about a bending axis while the pressure die moves forward in a line carrying the tube tangentially to the bend point. The pressure die holds back the reaction force to create the bend.

When hollow tubes are bent, there is a very decided tendency for the circular cross section to become oval in the curved or bent part of the tube. In particular, the inner radius of the bent portion of the tubing (the intrados) will wrinkle, or the outer radius (the extrados) will pull in short of a full circular arc and thin below the original tube wall thickness. These results are undesirable since they reduce cross sectional area of the tube through the bend, produce a tube which is not as strong as a tube with a circular cross section, and may result in thinner tube wall thickness along the extrados of the tube bend.

In some applications a wiper die, a die having a tangential groove with a knife edge that conforms to the bend die groove, is located adjacent the intrados opposite the pressure die to prevent wrinkling of the tube.

When thin walled tubes are bent to small bend radii, for example when tubes with a wall thickness of 0.095"–0.280" are bent to a bend radius between 1X–2X times the tube outer diameter, internal mandrels must typically be used to support the tubes during bending to improve and maintain the tube shape. The ASME Pressure Vessel Code Sections I and VIII permit engineering design of certain elements using tubes with thinner walls, provided they can be bent successfully. However, the need for an internal mandrel limits the practical length of tube that can be bent, since the tube must be slipped over the mandrel bars. The use of an internal mandrel also increases the amount of wall thinning that occurs on the extrados of the tube. Bending without the use of a mandrel is generally reserved for bends that are less than 180 degrees, or with tubing that has relatively thick walls, e.g. tubes with wall thicknesses greater than about 10% of the tube outer diameter.

Wiper dies and internal mandrels also frequently wear out or break, and are expensive to replace, which are further disadvantages of current tube bending apparatus and methods.

SUMMARY OF INVENTION

The present invention is drawn to an apparatus and method for bending thin walled tubes without the use of a wiper die or an internal mandrel. An external sleeve is used during the bending process which maintains the tube cross sectional area and tube wall thickness when making tight radius bends. In one embodiment the sleeve is split along its longitudinal axis.

It is an object of the present invention to provide a method and apparatus for making tubes with thin walls having tight radius bends.

It is another objective of this invention to make tight radius bends in tubes with thin walls.

It is a further object of the invention to provide a method and apparatus for maintaining tube cross sectional area while making tight radius tube bends.

It is yet another object of the invention to provide a method and apparatus for making tight radius tube bends which reduces the amount of thinning that occurs on the extrados of the tube.

Accordingly, the invention comprises an apparatus for bending a tube in a tube bend plane. The apparatus includes a sleeve for receiving a tube therein and a bend die mounted for rotation about a bending axis. A clamp die is directed toward the bend die for clamping the sleeve to the bend die. The sleeve has an inner surface engaged by the bend die and an outer surface engaged by the clamp die. The clamp die holds the sleeve to be bent as the bend die and clamp die rotate about the bending axis. A pressure die engages the outer surface of the sleeve for restraining a portion of the sleeve spaced away from the bend to be formed in the tube. The apparatus also includes means for rotating the bend die and clamp die to bend the sleeve and tube about the bend die.

In an alternate embodiment, the invention comprises a method for bending a tube, the tube having an outer diameter and the bend defining a tube bend plane. The steps of the method include inserting the tube into an external sleeve having an inner surface and an outer surface. A bend die mounted for rotation about a bending axis engages the inner surface of the sleeve. A clamp die engages the outer surface of the sleeve, clamping the sleeve and tube to the bend die. A pressure die is directed against the outer surface of the sleeve adjacent the clamp die. The clamp die and the bend die are then rotated to bend the sleeve and tube around the bend die.

In yet another embodiment, the invention comprises a method for bending a tube having a tube wall thickness less than about 10% of the tube outer diameter into a tight radius bend where the bend defines a tube bend plane. The steps of the method include inserting the tube into an external sleeve. The sleeve has an inner surface and an outer surface, and a first longitudinal slit located parallel to the tube bend plane between the inner surface and the outer surface. The inner surface of the sleeve engages with a bend die mounted for rotation about a bending axis. The outer surface of the sleeve engages with a clamp die to clamp the tube to the bend die. A pressure die is directed against the outer surface of the sleeve adjacent the clamp die. Rotating the clamp die and the bend die bends the tube and sleeve around the bend die.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

Figure 1:
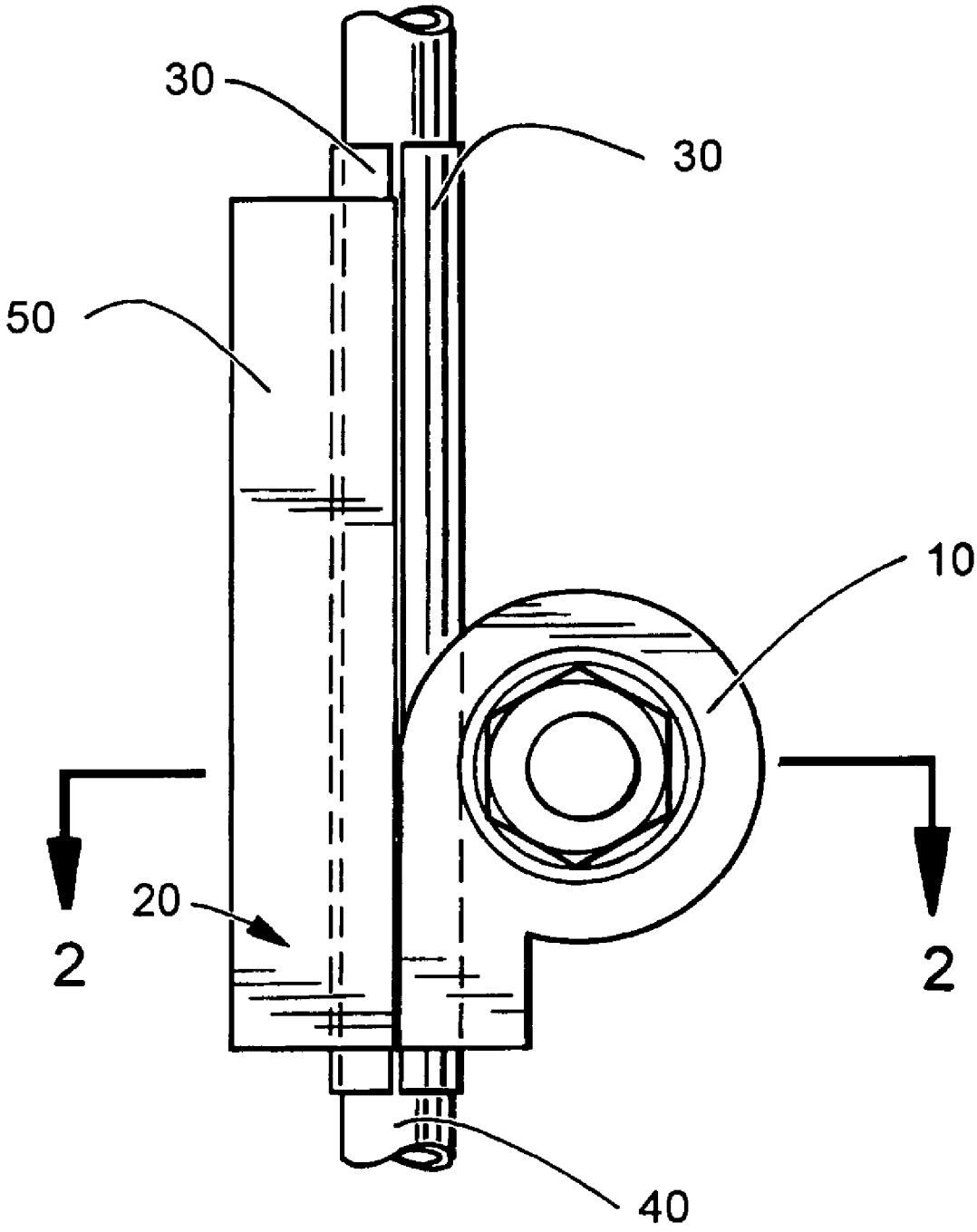
FIG. 1 is a schematic top view of an apparatus embodying the present invention.
Figure 2:
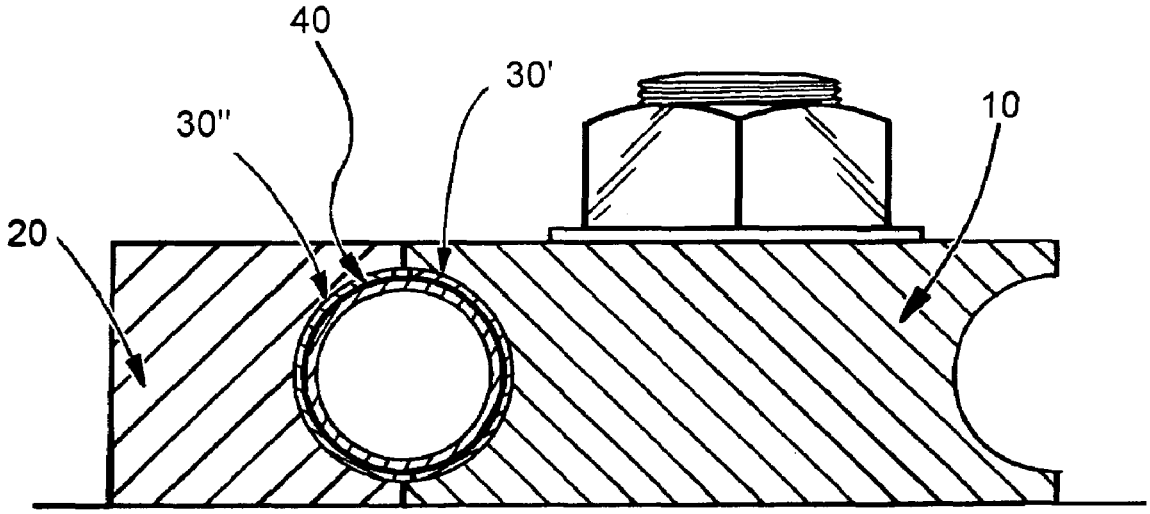
FIG. 2 is a schematic cross sectional view of an apparatus embodying the present invention taken along line 2—2 of FIG. 1.
Figure 3:
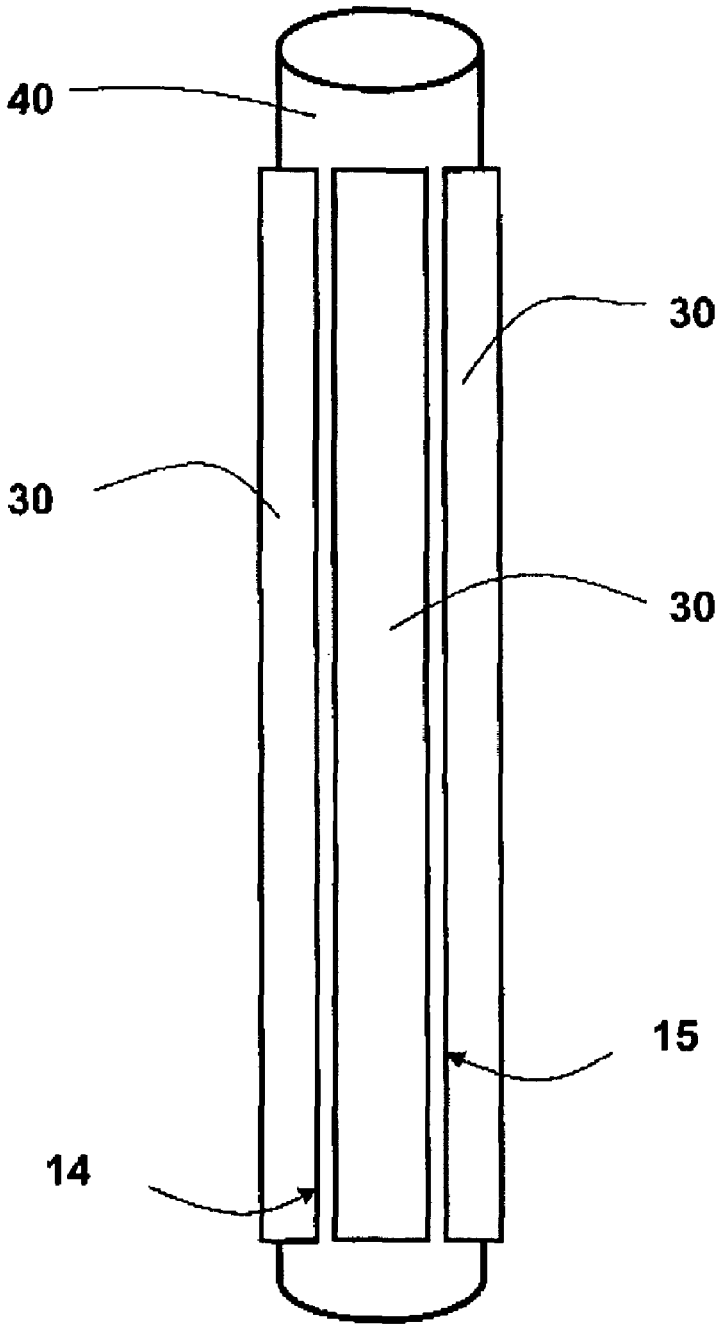
FIG. 3 is a schematic representation of an embodiment of the present invention wherein the sleeve contains more than one split along its longitudinal axis.

Referring to FIGS. 1, 2, and 3, tube 40 is inserted into an external sleeve 30. The external sleeve 30 is generally cylindrical, and is split 14 along its longitudinal axis in a direction parallel to the tube bend plane to create an inner sleeve portion 30', located adjacent the tube intrados (the inside radius of the tube bend), and an outer sleeve portion 30" adjacent the tube extrados (the external radius of the bend). The sleeve length is based on the arc length of the neutral axis of the bend plus a nominal clamping allowance. The outside diameter of the sleeve is selected to match the next standard O.D. size of tubes. For example if a 2" O.D. tube is being bent, a 2¼" O.D. sleeve would generally be selected, or if a 2¼" O.D. tube is being bent a 2½" O.D. sleeve would generally be selected. It is understood that one skilled in the art may utilize other tube and sleeve O.D. combinations in a manner allowing existing tooling to be used.

The inside diameter (I.D.) of the sleeve is generally selected to ensure that it matches the O.D. of the tube being bent within approximately +/−0.020". However, this is not critical as the shape will change and nest to the tube during bending as a result of the clearance at the two slots between the inner and outer sleeve.

In one embodiment, the sleeve is made of carbon steel, however the sleeve material is not limited to carbon steel as advantages from using other materials could also be realized. The use of a higher alloy material may also be used as the sleeve material. This will have the effect of moving the neutral axis towards the Extrados which will reduce wall thinning and ovality. Low alloy and stainless steel sleeves may also be used. In some cases the boiler environment is such that erosion/corrosion happens most at these bends and the bends have to be "shielded in use" using stainless steel sleeves fitted on over the bends. The bending method allows the sleeve that was placed over the tubes to aid bending to be left in place to act as a shield in service.

As shown in FIGS. 1 and 2, the tube and sleeve are clamped between bend tooling comprised of bend die 10; clamp die 20 and pressure die 50. The tube and sleeve are bent together around bend die 10 using methods known in the art. The use of external sleeve 30 locally thickens tube 40 in the bend arc area, thereby allowing thinner-walled tubes to be bent to tighter bend radii.

In another embodiment the sleeve may contain one 14 or more splits 15 along its longitudinal axis. A longitudinal split 14 in the sleeve allows the intrados portion of the sleeve to move independently from the extrados portion of the sleeve upon bending, thus lowering the compressive stresses within in the intrados, resulting in reduced intrados wall thickening. Further, the independent movement of the extrados portion of the sleeve lowers the tensile load applied to the extrados of the bend upon bending, thereby reducing the occurrence of wall thinning. These two advantages of the invention combine to reduce or eliminate the need for a wiper die and internal mandrel.

When an internal mandrel is no longer needed, tube 40 is not restricted to a length that would fit over a mandrel bar. The apparatus and method of the present invention thus allow thinner wall thickness tubes to be used with the resultant material savings. Cross section flow area reduction is also minimized.

The following examples are provided for the purpose of further illustrating the invention but are in no way to be taken as limiting as they are merely exemplary.

A sleeve of 2¼ inch O.D. with 0.110 inch minimum wall thickness was utilized in bending a 2 inch O.D. tubing with 0.125 inch minimum wall thickness utilizing the present invention. The sleeve posses an axial slit extending down it length such that when the sleeve is place over the 2 inch O.D. tubing the sleeve circumferentially encompasses the tubing with the exception of slit. During bending the slit was kept substantially vertical to allow the extrados and intrados of the 2 inch O.D. tubing to move independently of one another, therefore reducing the compressive loads that build up in the intrados. The above tube and sleeve configuration was then bent on a 2¾ inch radius bend die for 180 degrees of bend. Bending was conducted without a mandrel at 500 PSI boost. No wrinkles were observed in the bent tube which when measured possessed and ovality of 4%.

While specific embodiments and/or details of the invention have been shown and described above to illustrate the application of the principles of the invention, it is understood that this invention may be embodied as more fully described in the claims, or as otherwise known by those skilled in the art (including any and all equivalents), without departing from such principles. For example, on thicker materials, where the wrinkling of the intrados and wall thinning at the extrados is not as great, the sleeve need not be split at all if the bend is near the end of the tube and/or the sleeve is to remain on the tube after bending. Various thicknesses of sleeves can also be used to change the bending configuration to achieve optimum bending conditions. A single sleeve only on the intrados or a single sleeve only on the extrados could also be considered to achieve optimum bending conditions.

I claim:

1. An apparatus for bending a tube in a tube bend plane, comprising: a sleeve for receiving the tube therein a bend die mounted for rotation about a bending axis a clamp die directed toward the bend die for clamping the sleeve to the bend die, the sleeve having an inner surface engaged by the bend die, an outer surface engaged by the clamp die, and a first longitudinal slit located between the inner surface and the outer surface parallel to the tube bend plane, the clamp die holding the sleeve to be bent as the bend die and clamp dies rotate about the bending axis a pressure die engaged with the outer surface of the sleeve for restraining a portion of the sleeve spaced away from the bend to be formed in the tube; and means for rotating the bend die and clamp die to bend the sleeve and tube about the bend die.

2. The apparatus of claim 1, wherein the sleeve has a second longitudinal slit located between the inner surface and the outer surface parallel to the tube bend plane.

3. The apparatus of claim 1, wherein the sleeve comprises carbon steel.

4. A method for bending a tube, the tube having an outer diameter and the bend defining a tube bend plane, comprising: inserting the tube into an external sleeve, the external sleeve having an inner surfaces, an outer surface, and a first longitudinal slit located parallel to the tube bend plane between the inner surface and the outer surface of the sleeve; engaging the inner surface of the sleeve with a bend die mounted for rotation about a bending axis; engaging the outer surface of the sleeve with a clamp die for clamping the sleeve and a tube to the bend die; directing a pressure die against the outer surface of the sleeve adjacent the clamp die; and rotating the clamp die and the bend die to bend the sleeve and tube around the bend die.

5. The method of claim 4, wherein the sleeve has a second longitudinal slit located parallel to the tube bend plane between the inner surface and the outer surface of the sleeve opposite the first longitudinal slit.

6. The method of claim 4, wherein the sleeve is made of carbon steel.

7. The method of claim 4, wherein the tube is bent to a bend radius between about 1 to about 2 times the tube outer diameter.

8. The method of claim 4, wherein the tube has a tube wall thickness less than about 10% of the diameter of the tube.

9. The method of claim 8, wherein the tube is bent to a bend radius between about 1 to about 2 times the tube outer diameter.

10. The method of claim 4, wherein the tube has a tube wall thickness of about 0.095"–0.250."

11. The method of claim 10, wherein the tube is bent to a bend radius between about 1 to about 2 times the tube outer diameter.

12. A method for bending a tube into a tight radius bend, the tube having a tube wall thickness less than about 10% of the tube outer diameter, the bend defining a tube bend plane, comprising: inserting the tube into an external sleeve, the sleeve having an inner surface and an outer surface and a first longitudinal slit located parallel to the tube bend plane between the inner surface and the outer surface; engaging the inner surface of the sleeve with a bend die mounted for rotation about a bending axis; engaging the outer surface of the sleeve with a clamp die for clamping the tube to the bend die; directing a pressure die against the outer surface of the sleeve adjacent the clamp die; and rotating the clamp die and the bend die to bend the tube and sleeve around the bend die.

13. The method of claim 12, wherein the tube is bent to a bend radius between about 1 to about 2 times the tube outer diameter.

14. The method of claim 13, wherein the sleeve has a second longitudinal slit located parallel to the tube bend plane between the inner surface and the outer surface opposite the first longitudinal slit.

* * * * *